US006253756B1

(12) United States Patent
Petit

(10) Patent No.: US 6,253,756 B1
(45) Date of Patent: Jul. 3, 2001

(54) ACCESSORY FOR CUTTING DEVICE

(75) Inventor: Marc Petit, St. Victor (FR)

(73) Assignee: Diamant Boart S.A., Brussels (BE)

( * ) Notice: Subject to any disclaimer, the term of this patent is extended or adjusted under 35 U.S.C. 154(b) by 0 days.

(21) Appl. No.: 09/531,771

(22) Filed: Mar. 21, 2000

(30) Foreign Application Priority Data

Mar. 22, 1999 (FR) ..... 99 03704

(51) Int. Cl.[7] ..... B28D 1/14

(52) U.S. Cl. ..... 125/20; 451/415; 451/549; 225/96.5

(58) Field of Search ..... 125/20, 35, 23.02; 451/549, 259, 41, 150; 83/468.8, 468.4, 468.1; 225/96.5

(56) References Cited

U.S. PATENT DOCUMENTS 1,511,016 * 10/1924 Barker ..... 125/23.02
5,040,445 8/1991 Liou .
5,626,124 * 5/1997 Chen ..... 125/23.02

FOREIGN PATENT DOCUMENTS 296 06 950 U 7/1996 (DE) .
2322485A 10/1997 (GB) .

* cited by examiner

*Primary Examiner*—Robert A. Rose
(74) *Attorney, Agent, or Firm*—Lowe Hauptman Gilman & Berner, LLP

(57) ABSTRACT

Disclosed is an accessory mounted on a cutting device including two mutually parallel guide bars. The accessory includes a first channel formed in the accessory for receiving one of the two mutually parallel guide bars. A second channel is formed to receive the other of the two mutually parallel guide bars in such manner that the second guide bar is freely translatable in the second channel. An affixation device is firmly affixes the accessory to one of two mutually parallel guide bars.

10 Claims, 5 Drawing Sheets

ACCESSORY FOR CUTTING DEVICE

FIELD OF THE INVENTION

The present invention relates to an accessory for a cutting device such as a cutting tool for cutting ceramic tiles, for instance, an accessory to drill holes in the ceramic tiles.

BACKGROUND OF THE INVENTION

Tile cutters or the like in general include a base fitted with a small workbench on which the user deposits a tile to be cut. These tile cutters also comprise two guide bars mounted parallel to the plane of the workbench. A carriage slides on the two guide bars. The carriage supports a cutting tool, generally a carbide tip, to score the tile to be cut and a break off foot to rupture the tile along the scored line previously incised by the carbide tip.

If more complex cutting is required, such a cutter may need an accessory to perform the more complex cutting. Illustratively, a ceramic tile may have to be drilled through to allow a plumbing pipe to pass there through.

Illustratively such an accessory is mounted on the guide bars and is fitted with a tool which may assume two positions: a rest position wherein the accessory is retracted and an operating position wherein the accessory rests against the tile to be drilled.

Such accessories may be sold separately from the tile cutters. Consequently, the accessory must be adaptable to different kinds of tile cutters or the like. The tile cutters often differ in their dimensions, in particular, the diameters and the distances between the guide bars. Such tile cutters also may differ by the height of the guide bars relative to the workbench.

SUMMARY OF THE INVENTION

The objective of the present invention is to provide an accessory which can be mounted on the guide bars of a tile cutter and which shall be adaptable to different tile cutters and the like even the tile cutters have differing inter-bar distances and different diameters.

These and other objects of the present invention are achieved by an accessory mounted on a cutting device including two mutually parallel guide bars. The accessory includes a first channel formed in the accessory for receiving one of the two mutually parallel guide bars. A second channel is formed to receive the other of the two mutually parallel guide bars in such manner that the second guide bar is freely translatable in the second channel. An affixation device is firmly affixes the accessory to one of two mutually parallel guide bars.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
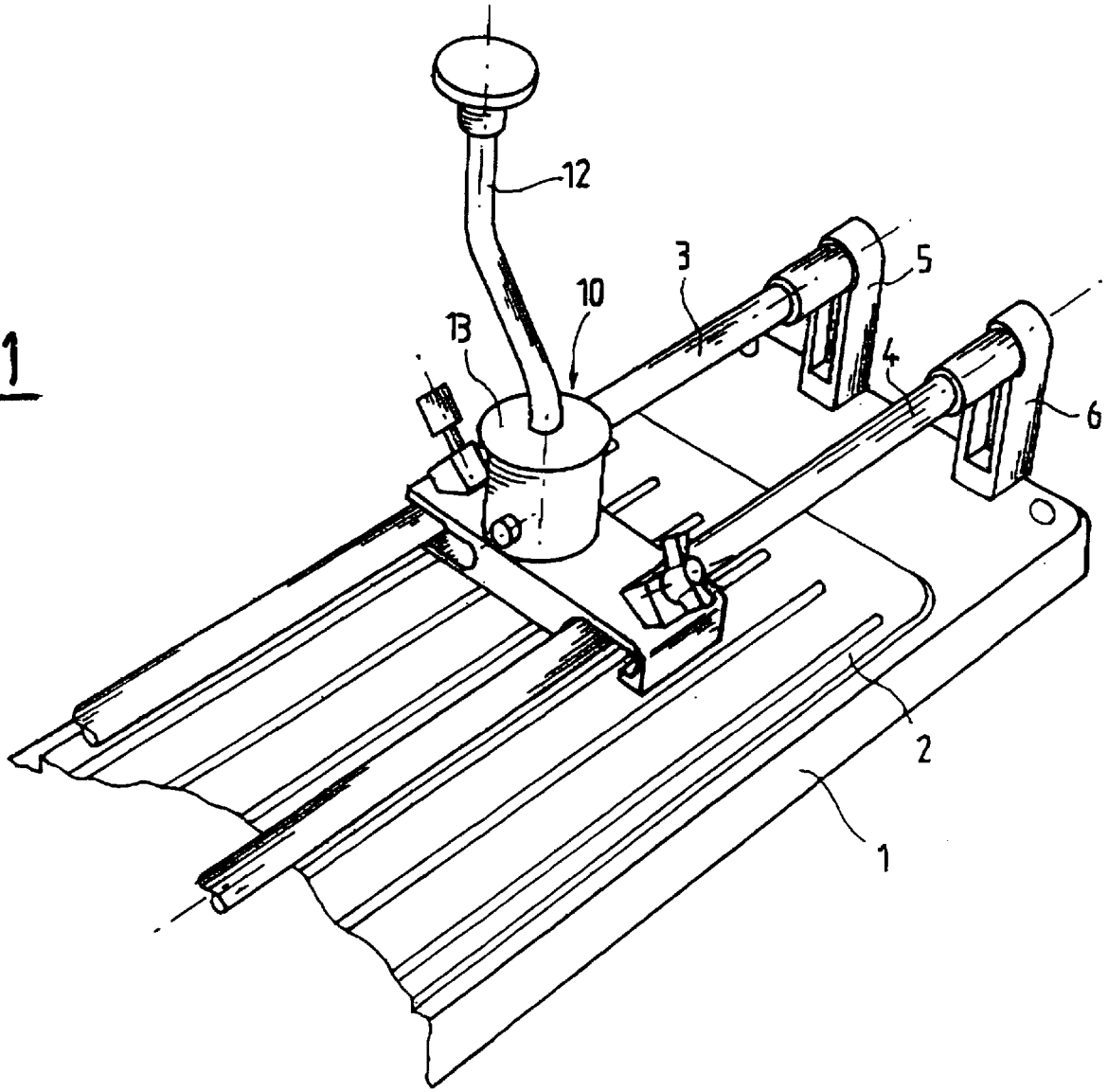
FIG. 1 is a partial perspective of a tile cutter on which is mounted an accessory of the present invention.

The tile cutter shown in FIG. 1 includes a base 1 fitted with a small workbench 2 on which the user may rest (for instance) a tile to be cut. This cutter furthermore comprises two horizontally extending guide bars 3 and 4 mounted in vertically extending posts 5 and 6. As depicted in FIG. 1, guide bars 3 and 4 are parallel to the plane of the workbench 2. A chariot (omitted) supports the cutting bit—in generally a carbide tip—designed to score the tile to be cut, and a rapture foot designed to break the tile along the scored line previously applied by the carbide tip.

The accessory of the present invention, generally indicated at 10, is designed to be mounted on the two guide bars 3 and 4 and to be detachably affixed to them. In the shown embodiment of a drill, where this accessory 10 is a bit, the accessory is fitted with a circular cutting tool 11 (not shown in FIG. 1 but depicted in FIGS. 2–5) which is driven into rotation by a handcrank 12. A drive element 13 allows lowering the tool 11 in such a way that it shall be tangent to and apply a pressure on the surface of the title to be drilled. In this manner a hole can be drilled in a ceramic tile for instance to pass a PVC pipe or another kind of pipe.

As shall be elucidated below, the present invention is applicable to an accessory 10 other than tile cutters.

Figure 2:
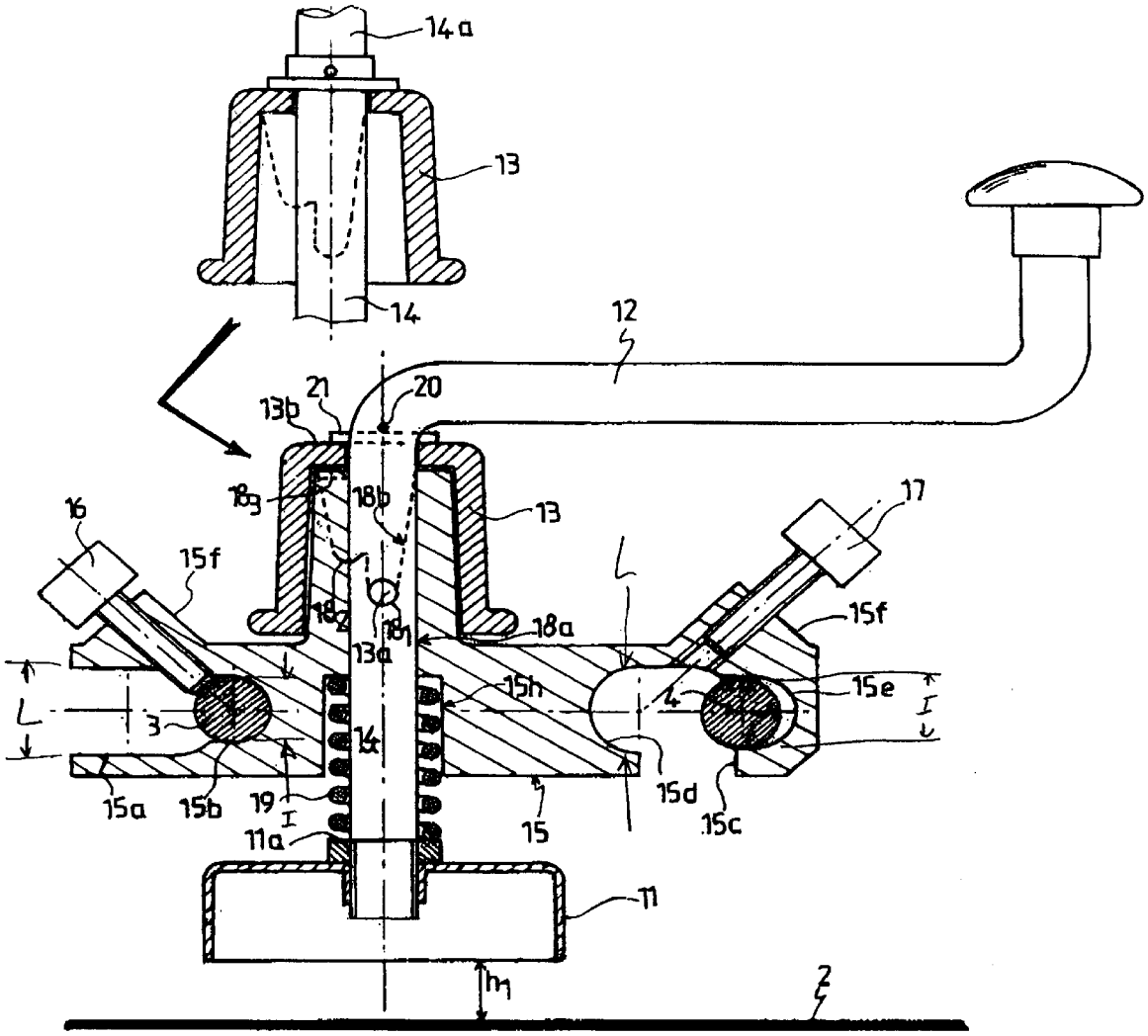
FIG. 2 is a section in a median plane of an accessory of the invention which is mounted on two guide bars of a tile cutter, the bars being of a small diameter and the tile cutter being in a first operational position.

FIG. 2 shows the accessory 10 of the present invention. In particular, FIG. 2 shows the circular cutting tool 11 driven by a shaft 14 and a handcrank 12, or as shown by the inset, by a shaft end 14*a* affixed for instance to a motor, such as an electric drill.

The accessory 10 includes a block 15 fitted at one of its ends with a first channel 15*a* having a semi-cylindrical inward extremity of a first width L and which is deepened by a second channel 15*b* of which the inward extremity also is semi-cylindrical and of a second width I less than said first width.

At the other end of the block 15 and in the same plane as the channels 15*a* and 15*b*, the block 15 comprises a slot 15*c* extending from a lower part of the block 15. Slot 15*c* extends sideways in the direction of the channels 15*a* and 15*b* forming a channel 15*d* of which the inward extremity is semi-cylindrical and of a width equal to the first width L, and in the direction away from the channels 15*a* and 15*b* by a channel 15*e* of which the inward extremity is semi-cylindrical and of a width the same as the second width I.

The block 15 comprises two angled elevations 15*f* which are crossed by affixation screws 16 and 17. The axis of the screw 16 passes through the axis of the semi-cylindrical part of the channel 15*b* which points toward the inside of the block 15. Again, the axis of the screw 17 passes through the axis of the semi-cylindrical part of the channel 15*d* which points toward the inside of the block 15.

The block 15 of FIG. 2 is mounted on the two guide bars 3 and 4 of which the diameters are equal to the widths 1 of the channels 15*b* and 15*e*. The bars 3 and 4 are received in these channels 15*b* and 15*e*. The screw 16 is tightened on the bar 3 which it forces against the inward extremity of the channel 15*b*. In this manner, the block 15 is firmly affixed to the bar 3. On the other hand, the bar 4 is freely translatable inside the channel 15*e* as a result of which the block 15 can adapt to different distances between the bars 3 and 4 axes.

Figure 3:
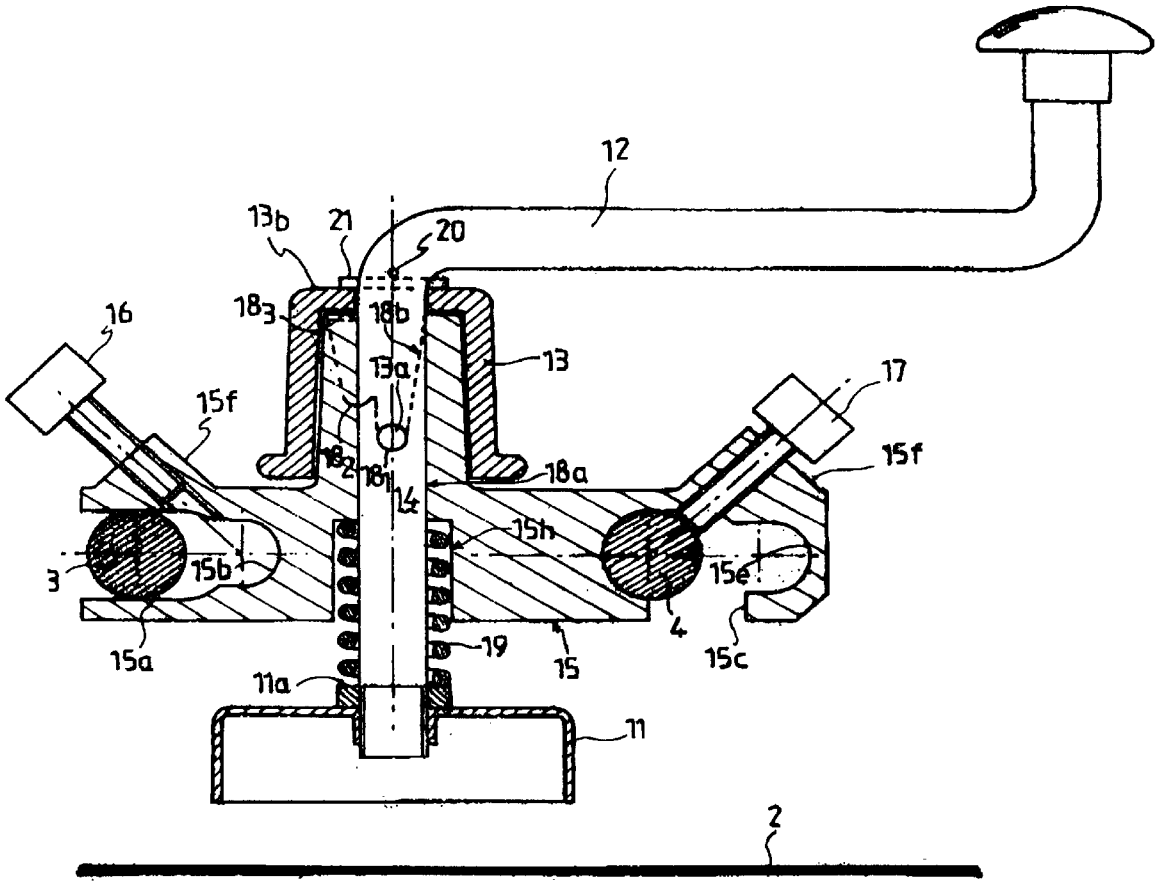
FIG. 3 is a section in a median plane of an accessory of the invention which is mounted on two guide bars of a tile cutter, the bars being of a large diameter.

The block of FIG. 3 is mounted on the two guide bars 3 and 4 of which the diameters are equal to the widths L of the channels 15*a* and 15*d*. The bars 3 and 4 are received in these channels 15*a* and 15*d*. The screw 17 is tightened on the bar 4 which it forces against the inward extremity of the channel 15*d*. In this manner, the block 15 is firmly affixed to the bar 4. On the other hand, the bar 3 is freely translatable inside the channel 15*a* as a result of which the block 15 can adapt to different distances between the bar 3 and 4 axes.

The block 15 is initially assembled with the bar 3 inside the channel 15*b* and then is pivoted in such a way as to insert the bar 4 into the slot 15*c* and then into the channel 15*e*.

The block 15 shown in FIG. 3 is assembled to two bars 3 and 4 of diameters equal to the width L of the channels 15*a* and 15*b*. These bars 3 and 4 are respectively received in the channels 15*a* and 15*d*. The screw 17 is tightened on the bar 4 and the screw 17 presses the guide bar 4 against the inward extremity of the channel 15*d*. In this manner, the block 15 is rigidly joined to the bar 4. On the other hand the bar 3 is free inside the channel 15*a* and as a result the block 15 is adaptable to different distances between the bars' axes.

As above, the block 15 is first assembled to the bar 3 inserted into the channel 15*a* and then is pivoted to move the bar 4 into the slot 15*c* and then into the channel 15*d*.

As regards a set of guide bars 3 and 4 of the given diameter, the channels 15*b* and 15*d* assume the same function, namely they receive at their inward extremities a first bar of the set in such a manner that these bars can be firmly affixed in particular by the screws 16 and 17. The channels 15*a* and 15*e* assume the same functions, namely to guide a second bar of the set in order to adapt the block to bars spaced apart at different distances.

The block 15 is fitted with a boss 18 comprising a borehole 18*a* passing the shaft 14 which, at its lower free end (FIGS. 2–5) bears the circular cutting tool 11. A compression spring 19 is mounted between a shoulder 11*a* of the tool 11 at one end and the extremity of a blind hole $\mathbf{15}^h$ at the other end.

The boss 18 comprises an upper surface 18*b* with a negative and then a positive slope over about 90° and with troughs $\mathbf{18}_1$, $\mathbf{18}_2$ and $\mathbf{18}_3$ of which the bottoms are at three different heights relative to the block 15, for instance relative to the base of the boss 18. The surface 18*b* is a cam.

The drive element 13 is fitted with a means cooperating with the upper surface 18*b* and its troughs $\mathbf{18}_1$, $\mathbf{18}_2$ and $\mathbf{18}_3$ of said boss 18. In the embodiments shown in FIGS. 2–5, the means is a radial pin 13*a*.

Near the upper surface 13*b* of the drive element 13, the shaft 14 is fitted with a stop 20, for instance a pin or a circlip crossing the shaft 14 and with a washer resting on the surface 13*b*. The purpose of this top is to block the shaft 14 against translation relative to the drive element 13.

In FIG. 2, the pin 13*a* of the drive element 13 is housed in the lower trough $\mathbf{18}_1$. The upper surface 13*b* of the drive element 13 therefore is situated at a first, shallow height relative to the block 15. Because the shaft 14 is stopped by the stop 20 and washer 21 at this upper surface 13*b*, the tool 11 is situated at a first shallow height $h_1$ relative to the small workbench 2 at a first operational height illustratively corresponding to a first model of tile cutter or the like.

Figure 4:
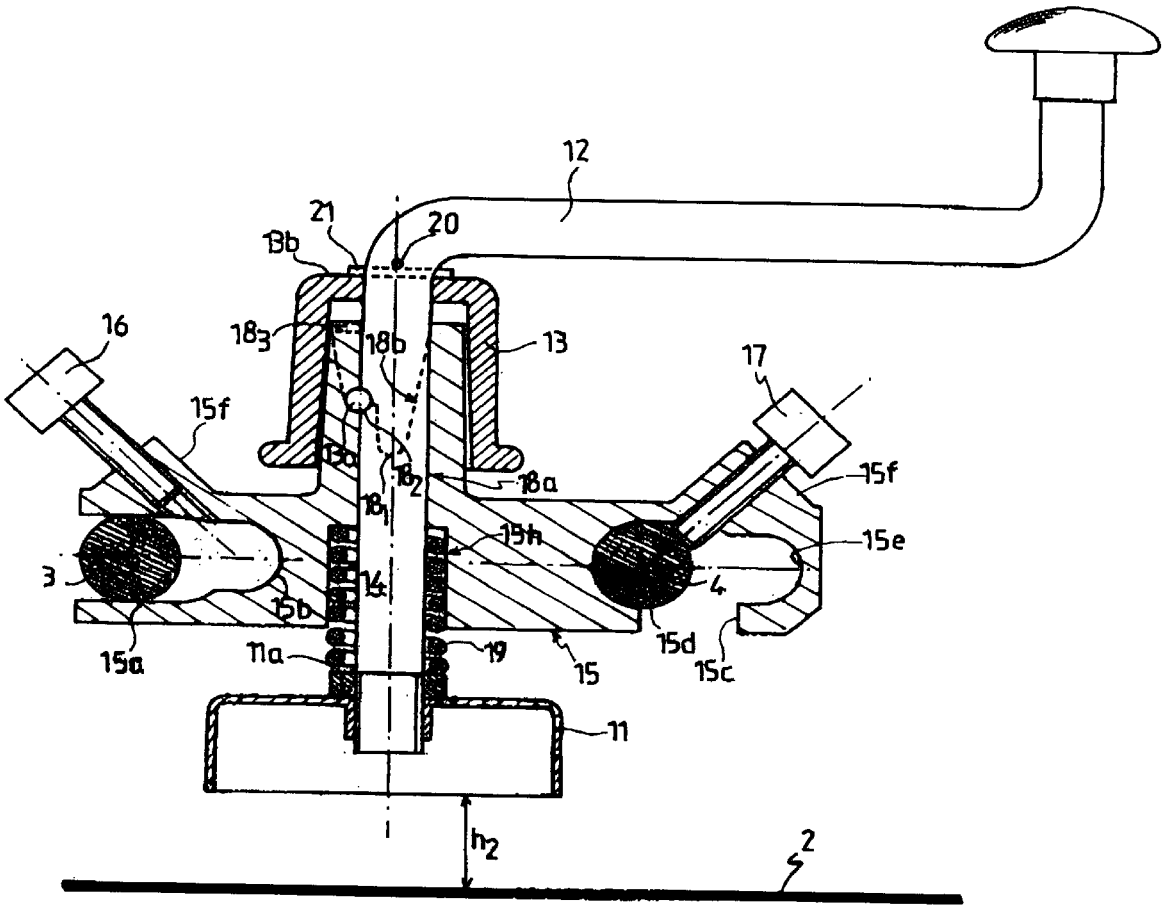
FIG. 4 is a view identical with that of FIG. 3 except that the tile cutter is in a second operational position.

In FIG. 4, the pin 13*a* of the drive element 13 is seated in the intermediate through $\mathbf{18}_2$. The upper surface 13*b* of the drive element 13 therefore is situated at a second, intermediate height relative to the block 15. Because the shaft 14 rests is stopped against this upper surface 13*b*, the tool 11 is situated at a second, intermediate height $h_2$ relative to the workbench 2 and corresponding to a second operational height for instance for a second model of tile cutter or the like.

Figure 5:
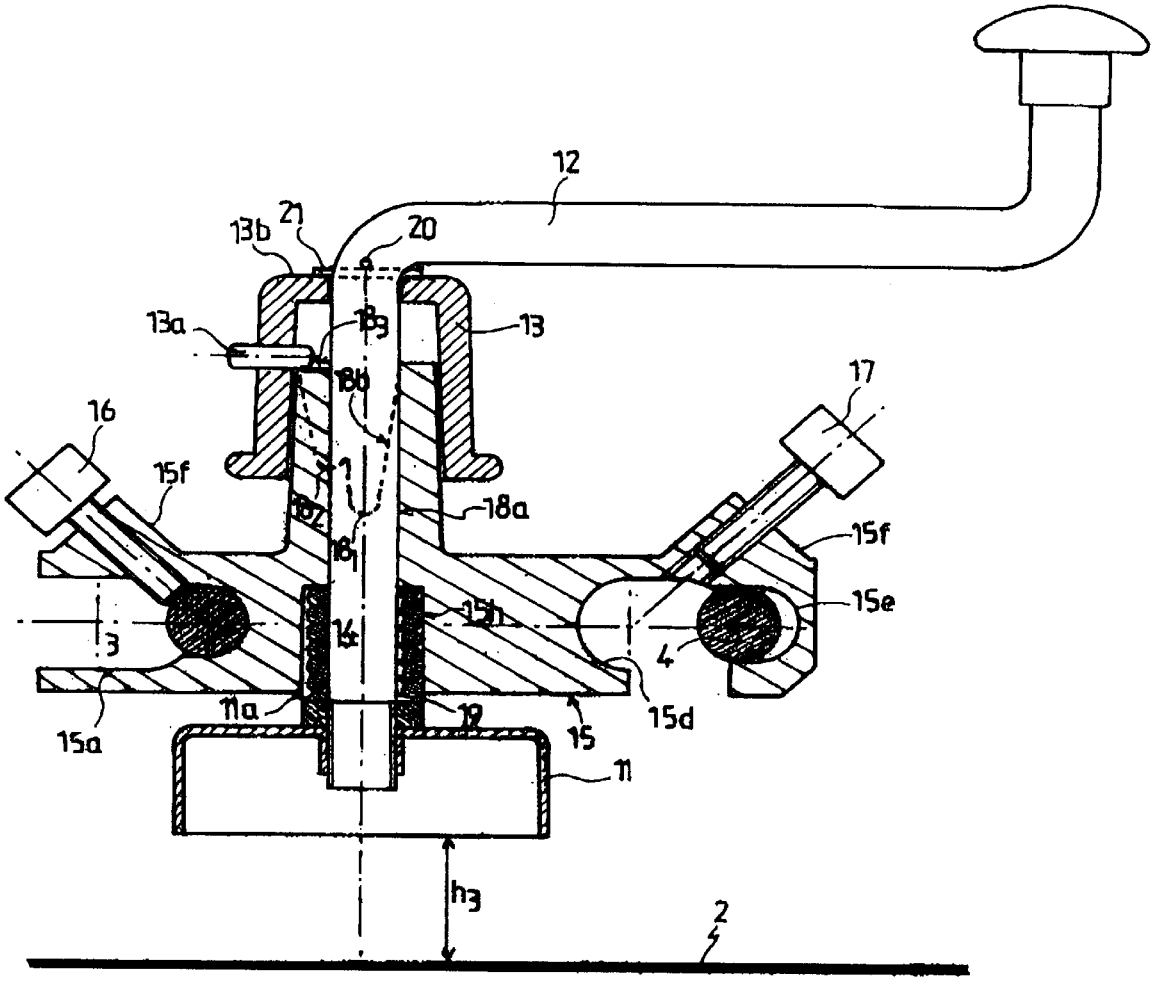
FIG. 5 is a view identical with that of FIG. 2 except that the tile cutter is in its rest position.

Lastly, in FIG. 5, the pin 13*a* of the drive element 13 is seated in the upper trough $\mathbf{18}_3$. The upper surface 13*b* of the drive element 13 therefore is situated at a third height relative to the block 15. The tool 11 is situated at a third height $h_3$ relative to the workbench 2 corresponding to its retracted position regardless of the tile cutter's model.

It is understood that the drive element allows selecting either position depending on the kind of model of tile cutter or other device selected.

It is also understood that the number of operational positions is not restricted to two but may be larger depending on the number of device models to be serviced by the accessory.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An accessory mounted on a cutting device including two mutually parallel guide bars, said accessory comprising:

a first channel formed in the accessory for receiving one of said two mutually parallel guide bars;

a second channel formed to receive the other of said two mutually parallel guide bars in such manner that the other of said two mutually parallel guide bars is freely translatable in said second channel;

an affixation device to firmly affix said accessory to one of two mutually parallel guide bars;

a block to be mounted on said two guide bars and bearing a rotary shaft of which a free end is fitted with a tool;

a drive element resting on said block and including a drive part;

a series of shoulders formed in said drive element to selectively assume different heights relative to said block and a stop cooperating with said drive part of said drive element and to stop said shaft in a translational direction relative to said drive element.

2. The accessory of claim 1, wherein the first and second channels are co-planar, and the first channel has a first portion having a given width and a second portion having a width slightly greater than a width of one of the guide bars and the second channel has a width of the other of the guide bars, the given width being greater than the width of the second portion.

3. The accessory of claim 1, wherein the first and the second channel extend outwardly in a direction perpendicular to a longitudinal axis extending through each of the channels.

4. The accessory of claim 2, wherein the first and the second channel extend outwardly in a direction perpendicular to a longitudinal axis extending through each of the channels.

5. The accessory of claim 1, wherein said first and second channels are each semi-cylindrical at their inward extremities.

6. The accessory of claim 5, wherein said affixation device comprises screws of which the axes pass through axes of the semi-cylindrical portions of the corresponding first channels.

7. The accessory of claim 1, further comprising a second affixation device to firmly affix said accessory to the other of said two mutually parallel guide bars.

8. The accessory of claim 1, further comprising return means biasing said shaft toward the position wherein it is stopped by said stop.

9. The accessory of claim 8, wherein said means comprises a cam comprising a plurality of troughs at different heights relative to said block and means to be received in at least one of said troughs to define said rest position or an operational position.

10. The accessory of claim 9, wherein said cam is shaped into the block and the means received into at least one of said troughs of said cam comprise a pin firmly joined to said drive element.

* * * * *